US012448859B2

(12) United States Patent
Jaramillo et al.

(10) Patent No.: US 12,448,859 B2
(45) Date of Patent: Oct. 21, 2025

(54) ROTARY TOOL HYDRAULIC POWER SYSTEM

(71) Applicant: Schlumberger Technology Corporation, Sugar Land, TX (US)

(72) Inventors: Juan Jose Jaramillo, Stonehouse (GB); Todor Sheiretov, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/725,199

(22) PCT Filed: Mar. 13, 2023

(86) PCT No.: PCT/US2023/064246

§ 371 (c)(1),
(2) Date: Jun. 28, 2024

(87) PCT Pub. No.: WO2023/173138

PCT Pub. Date: Sep. 14, 2023

(65) Prior Publication Data

US 2025/0084716 A1 Mar. 13, 2025

Related U.S. Application Data

(60) Provisional application No. 63/269,224, filed on Mar. 11, 2022.

(51) Int. Cl.
*E21B 29/00* (2006.01)
*E21B 17/10* (2006.01)
(Continued)

(52) U.S. Cl.
CPC ..... *E21B 29/005* (2013.01); *E21B 17/1014* (2013.01); *E21B 33/1285* (2013.01); *E21B 37/04* (2013.01)

(58) Field of Classification Search
CPC ..... E21B 29/005
See application file for complete search history.

(56) References Cited

U.S. PATENT DOCUMENTS 5,603,386 A * 2/1997 Webster ..... E21B 44/005 175/45
9,441,436 B2 9/2016 Hallundbæk
(Continued)

FOREIGN PATENT DOCUMENTS

CN 112943139 A 6/2021
EP 0481767 A1 4/1992
(Continued)

*Primary Examiner* — David Carroll
(74) *Attorney, Agent, or Firm* — Jeffrey D. Frantz

(57) ABSTRACT

The present disclosure generally relates to a downhole mechanical services tool, and more particularly to a hydraulic power system which makes power available to rotary tools for actuating a variety of accessories of cutting, milling, brushing and polishing. For example, a downhole well tool hydraulic power system may include a rotary module configured to rotate relative to a body of the downhole well tool hydraulic power system. The downhole well tool hydraulic power system may also include a hydraulic pump module configured to pressurize a compensated hydraulic fluid for delivery to the rotary module. The downhole well tool hydraulic power system may further include a compensator configured to deliver the compensated hydraulic fluid to the hydraulic pump module. In addition, the downhole well tool hydraulic power system may include a pressure barrier between the hydraulic pump module and the rotary module.

17 Claims, 6 Drawing Sheets

(51) Int. Cl.
*E21B 33/128* (2006.01)
*E21B 37/04* (2006.01)

(56) References Cited

U.S. PATENT DOCUMENTS

| | | | | |
|---|---|---|---|---|
| 2009/0050373 | A1* | 2/2009 | Loretz | E21B 34/08 175/93 |
| 2014/0124191 | A1* | 5/2014 | Hallundb | E21B 29/005 166/55.2 |
| 2015/0354306 | A1 | 12/2015 | Fuller | |
| 2018/0347350 | A1* | 12/2018 | Frith | E21B 47/24 |
| 2021/0254422 | A1* | 8/2021 | Sheiretov | E21B 23/01 |
| 2025/0075579 | A1 | 3/2025 | Cygan | |

FOREIGN PATENT DOCUMENTS

| | | | |
|---|---|---|---|
| EP | 0765428 | B1 | 9/1998 |
| EP | 2530238 | B1 | 12/2013 |

* cited by examiner

ROTARY TOOL HYDRAULIC POWER SYSTEM

CROSS-REFERENCE TO RELATED APPLICATION

This application is a national stage entry under 35 U.S.C. § 371 of International Application No. PCT/US2023/064246, filed Mar. 13, 2023, which claims priority to and the benefit of U.S. Provisional Application No. 63/269,224, entitled "ROTARY TOOL HYDRAULIC POWER", filed Mar. 11, 2022, which is herein incorporated by reference in its entirety for all purposes.

BACKGROUND

The present disclosure generally relates to a downhole mechanical services tools, and more particularly to rotary tools which need to have hydraulic power available in the rotating part for actuating a variety of accessories of cutting, milling, brushing, and polishing.

One example of such applications is a tubing cutter tool, where cutting knives or pads need to be radially extended from the tool body to cut the pipe. Other examples are expandable bits, under-reamer bits, and expandable brushes or hones for cleaning and polishing of wellbore walls. Another example is increasing the weigh on bit in milling applications.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

A conventional solution for transmitting hydraulic power from a pump to a rotating shaft is to have hydraulic lines along the length of the entire rotary module. The relatively high pressure is then routed to the rotating part through a flow channel located between a pair of dynamic rotary seals. Other tools do have hydraulic actuators in which the motion of the piston is achieved by having high pressure hydraulic fluid on one side borehole fluid on the other. The difference is that these tools are not rotary tools and do not have any rotating seals. In addition, they do not have any of the components like gears whose load capacity is adversely affected by the presence of flow passages.

SUMMARY

A summary of certain embodiments described herein is set forth below. It should be understood that these aspects are presented merely to provide the reader with a brief summary of these certain embodiments and that these aspects are not intended to limit the scope of this disclosure.

Disclosed herein is a hydraulic power system where the entire rotary module internal volume is pressurized against the wellbore annulus by pumping hydraulic fluid across a pressure barrier located between the rotary module and section of the tool that houses the hydraulic pump and the oil reservoir and pressure compensator.

One aspect of the system is that the oil volume originally intended for compensation is being repurposed as a means to transmit hydraulic pressure below a component transmitting rotational motion. By pressurizing the internal oil filled cavities, the tool can transmit hydraulic power without additional dedicated hydraulic lines.

Certain embodiments of the present disclosure include a downhole well tool hydraulic power system that includes a rotary module configured to rotate relative to a body of the downhole well tool hydraulic power system. The downhole well tool hydraulic power system also includes a hydraulic pump module configured to pressurize a compensated hydraulic fluid for delivery to the rotary module. The downhole well tool hydraulic power system further includes a compensator configured to deliver the compensated hydraulic fluid to the hydraulic pump module. In addition, the downhole well tool hydraulic power system includes a pressure barrier between the hydraulic pump module and the rotary module.

Certain embodiments of the present disclosure also include a downhole well tool that includes a rotary milling module configured to rotate relative to a body of the downhole well tool, and a hydraulic power system. The hydraulic power system includes a hydraulic pump module configured to pressurize a compensated hydraulic fluid for delivery to the rotary milling module. The hydraulic power system also includes a compensator configured to deliver the compensated hydraulic fluid to the hydraulic pump module. The hydraulic power system further includes a pressure barrier between the hydraulic pump module and the rotary milling module.

Certain embodiments of the present disclosure also include a method that includes delivering compensated hydraulic fluid from a compensator to a hydraulic pump module of a hydraulic power system of a downhole well tool. The method also includes pressurizing the compensated hydraulic fluid using the hydraulic pump module of the hydraulic power system of the downhole well tool. The method further includes delivering the pressurized compensated hydraulic fluid from the hydraulic pump module to a rotary module of the downhole well tool. In addition, the method includes rotating the rotary module of the downhole well tool relative to a body of the downhole well tool using the pressurized compensated hydraulic fluid.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
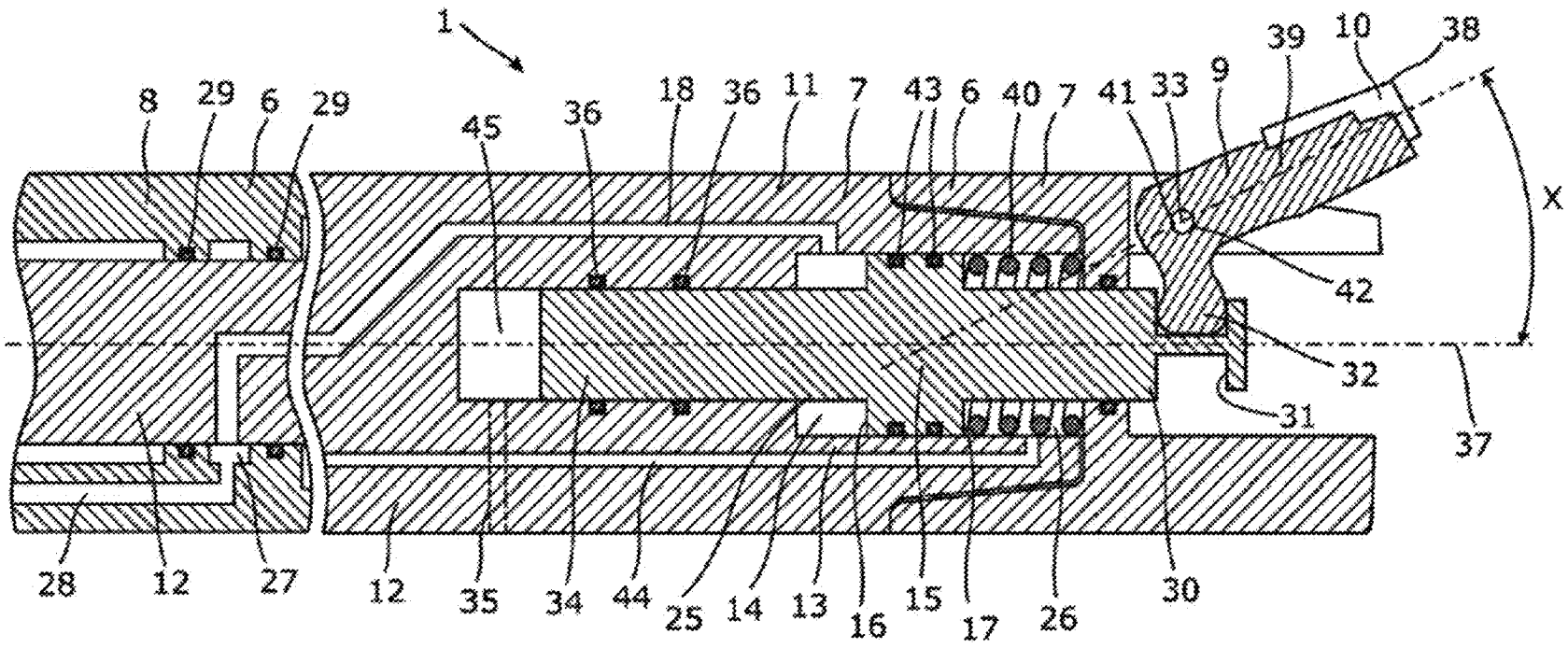
FIG. 1 (PRIOR ART)
FIG. 1 is a schematic diagram of a downhole mechanical service tool in which hydraulic fluid is routed to the rotating part of the tool using hydraulic passages in the tool body and a pair of rotary seals.

One or more specific embodiments of the present disclosure will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and operation-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain examples commensurate in scope with the originally claimed subject matter are discussed below. These examples are not intended to limit the scope of the disclosure. Indeed, the present disclosure may encompass a variety of forms that may be similar to or different from the examples set forth below.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth being the lowest (e.g., downhole or lower) point, whether the well (e.g., wellbore, borehole) is vertical, horizontal or slanted relative to the surface.

In addition, as used herein, the terms "approximately," "about," "generally," and "substantially" represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequently, during operations of the systems (e.g., while the systems are operating). In addition, as used herein, the terms "continuous", "continuously", or "continually" are intended to describe operations that are performed without any significant interruption. For example, as used herein, control commands may be transmitted to certain equipment every five minutes, every minute, every 30 seconds, every 15 seconds, every 10 seconds, every 5 seconds, or even more often, such that operating parameters of the equipment may be adjusted without any significant interruption to the closed-loop control of the equipment. In addition, as used herein, the terms "automatic", "automated", "autonomous", and so forth, are intended to describe operations that are performed are caused to be performed, for example, by a control system (i.e., solely by the control system, without human intervention).

The embodiments described herein include a hydraulic power system where the entire rotary module internal volume is pressurized against the wellbore annulus by pumping hydraulic fluid across a pressure barrier located between the rotary module and a section of the tool that houses the hydraulic pump and the oil reservoir and pressure compensator. Advantages of the hydraulic power system include, but are not limited to:

1. No need for hydraulic passages in the rotary module. This makes a larger part of the cross section available for other components such as motors and gearboxes. Load capacity of such components is relatively sensitive to their outer diameter and any space allocated for hydraulic lines can severely limit the performance of the rotary module.
2. There is only one high-pressure differential rotary seal in the tool instead of two, as in conventional solutions. This improves the system reliability, and it reduces the number of failure-prone components such as dynamic seals.

3. Allows the usage of legacy rotary modules without any modification, which eliminates the need for additional investment in new assets.

This system allows an existing rotary tool to use the internal compensation oil to convey pressure from an uphole end connection to the rotary shaft on the downhole end connection. Thus, the rotary tool can now be used without modification for many other applications, as described above.

FIG. 1 is a schematic diagram of a downhole mechanical service tool 1 in which hydraulic fluid is routed to the rotating part of the tool using hydraulic passages in the tool body and a pair of rotary seals. In contrast, as described above, the embodiments described herein eliminate the need for hydraulic passages in the rotary module.

Figure 2:
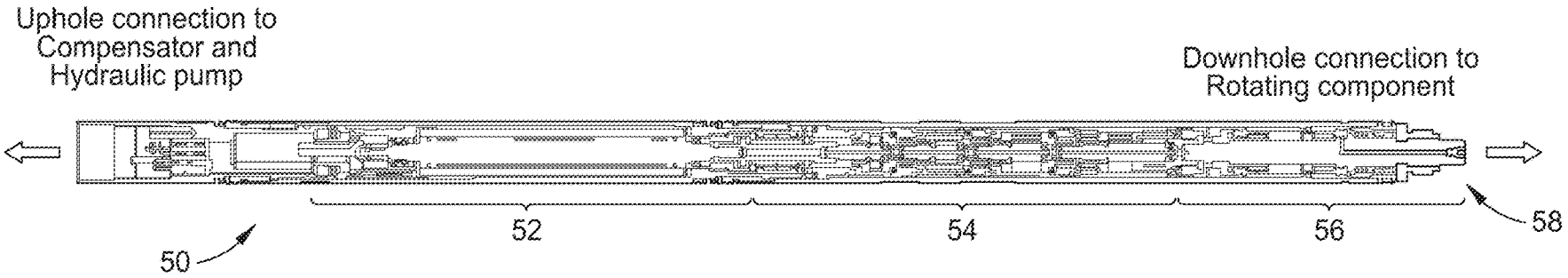
FIG. 2 is a schematic diagram of a downhole mechanical service tool, in accordance with embodiments of the present disclosure.

FIG. 2 is a schematic diagram of a downhole mechanical service tool 50 (e.g., downhole well tool) in accordance with the embodiments described herein. In certain embodiments, the hydraulic power system described herein may be used in a milling tool 50. In certain embodiments, the tool 50 may include a pressure vessel containing an electric motor 52, speed reducing gearbox train 54, and an output shaft 56 as illustrated in FIG. 2. Some intervention tools must satisfy a 2⅛" outer diameter (OD) requirement. In order to maximize the torque output in such a relatively small package, the tool 50 may be internally compensated with hydraulic oil, the compensation minimizing the wall thickness of the pressure housing by keeping a 200 psi internal pressure rather than, for example, the 20,000 psi required by the mission profile of the service.

In many well intervention applications, it is desirable to deliver actuation forces to the rotating portion of the tool 50 on the downhole side 58. The power source for these actuators can be electrical or hydraulic, the problem lies in that in both ways, a dedicated line-whether a wire or a pressurized hydraulic flowline-must bypass the milling module from an uphole to a downhole connection. Given the geometry of the internal components (motor, gearboxes, and so forth) and the relatively tight packaging constraints, the most efficient way to achieve this is to enlarge the OD of the housing. This consequence not only generally goes against the mission profile of the service but requires a relatively major redesign effort.

The embodiments described herein utilize the compensation oil to deliver the pressure to the rotary portions connected downhole. Achieving this goal requires the use of existing modules such as the hydraulic pump module, compensator, and the addition of a pressure barrier between the hydraulic pump module and the rotary milling module. By controlling the pump speed and the solenoid in the hydraulic pump module, a given (e.g., predetermined) pressure level may be delivered directly to the milling tool output shaft and therefore to any actuator connected on the downhole end.

Figure 3:
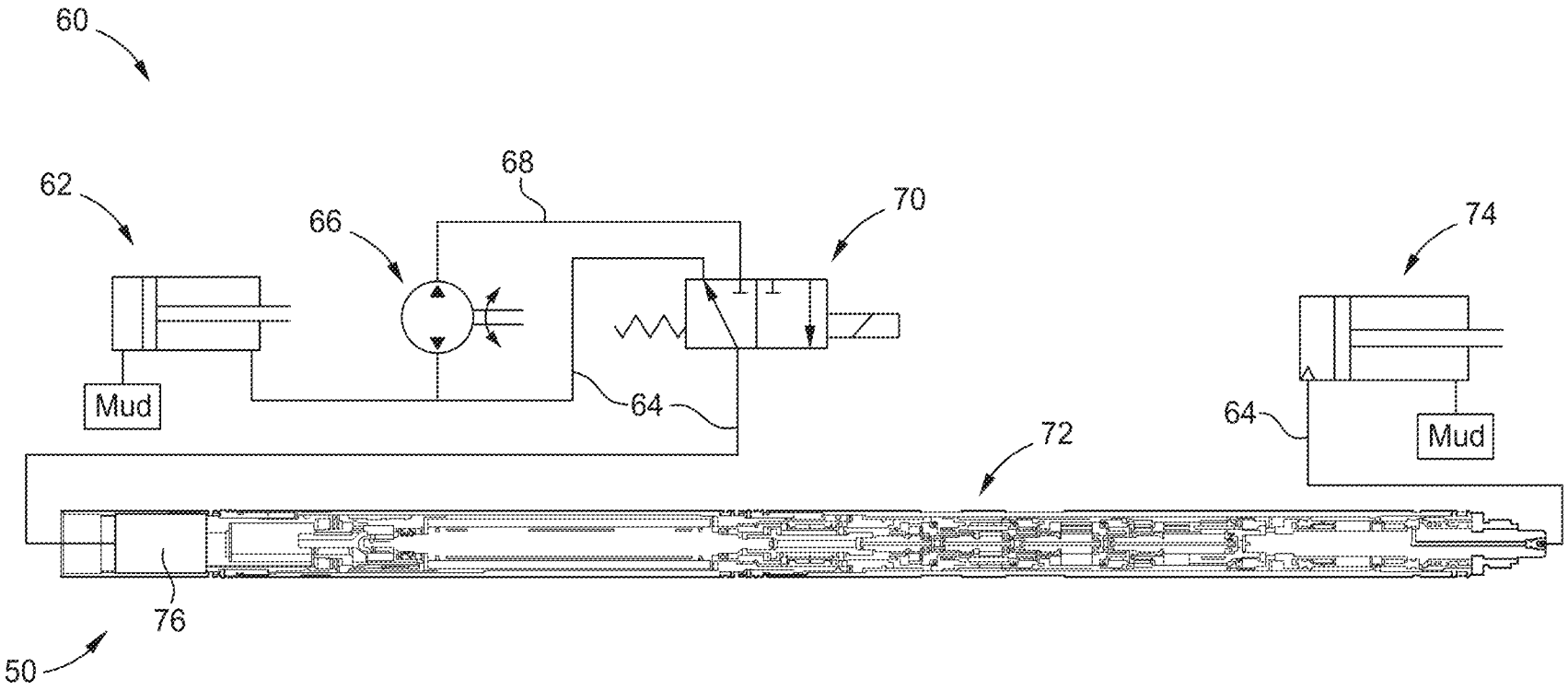
FIG. 3 is a schematic diagram depicting the components of the hydraulic power system with the valve in the passive state, in accordance with embodiments of the present disclosure.

FIG. 3 is a schematic diagram depicting the components of the hydraulic power system 60 described herein with the valve in a passive state. FIG. 3 depicts the oil routing among all the components in the drill string. An oil compensator 62 delivers borehole pressure to the internal oil depicted in lines 64 (e.g., the oil in lines 64 is pressure-compensated relative to the borehole pressure). The existing hydraulic pump module 66 pressurizes the compensated oil in line 68. A hydraulic control module 70, which may reside inside the hydraulic pump module 66, may consist of a 3/2-way valve driven by an electric solenoid. FIG. 3 depicts the valve (e.g., of the hydraulic control module 70) in a passive state, connecting the compensated oil to the rotary milling module 72 and any actuator 74 connected below the output shaft 56.

Figure 4:
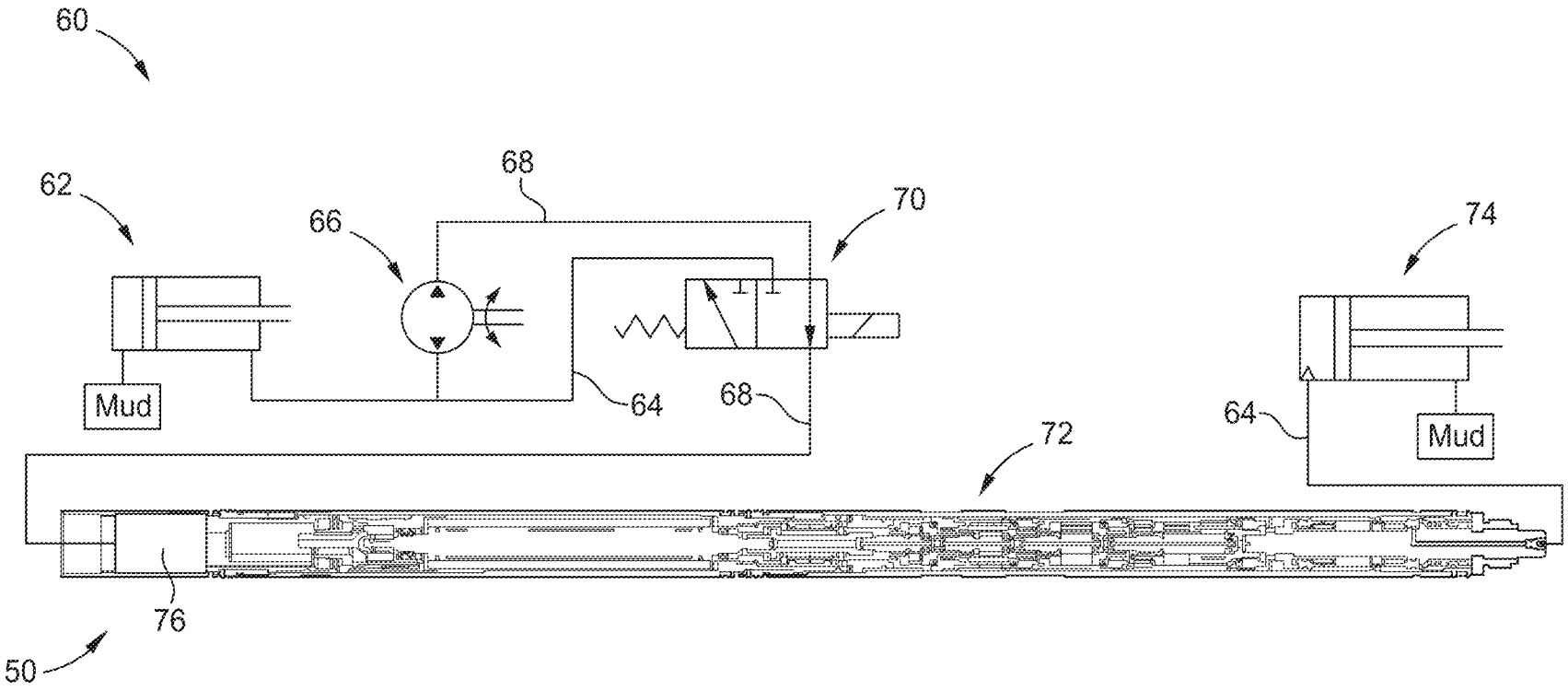
FIG. 4 is a schematic diagram depicting the components of the hydraulic power system, in accordance with embodiments of the present disclosure.

As an actuation force is required on the rotary portion of the tool 50, the solenoid may be triggered in the hydraulic control module 70, shifting the valve (e.g., of the hydraulic control module 70) and connecting the high pressure output of the hydraulic pump module 66 to the rotary milling module 72 and effectively delivering the desired (e.g., predetermined) pressure to any actuator 74 located below the milling tool 50, as illustrated in FIG. 4. As described above, in certain embodiments, addition of a pressure barrier 76 between the hydraulic pump module 66 and the rotary milling module 72 facilitates delivery of the compensation oil to the rotary portions of the milling tool 50 (e.g., the rotary milling module 72), as described herein.

Figure 5:
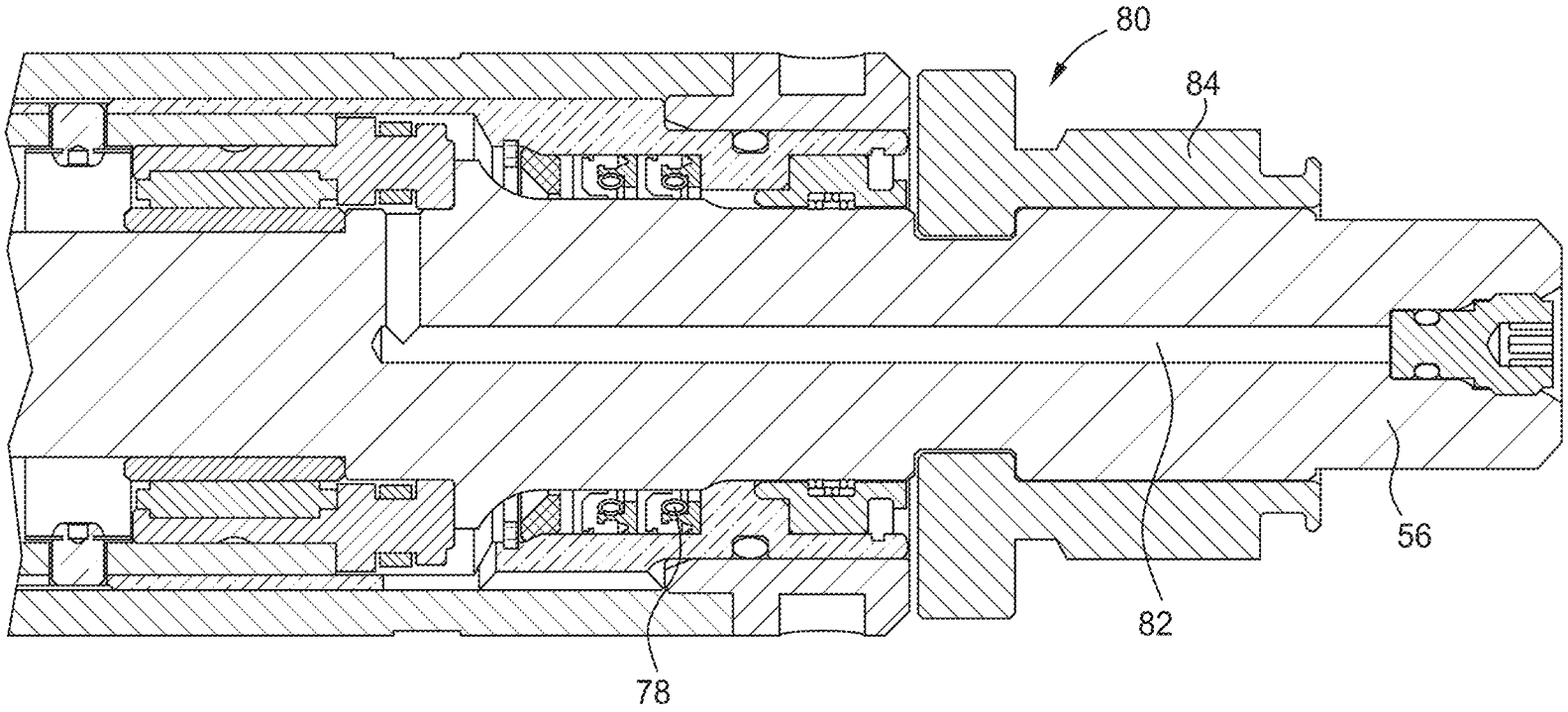
FIG. 5 is a schematic diagram depicting an example placement of dynamic rotary seals, in accordance with embodiments of the present disclosure.

In certain embodiments, one component of the hydraulic power system 60 is a single dynamic rotary seal (DRS) 78 located on the output shaft 56. These seals were originally intended to handle the compensator pressure (100-200 psi) under dynamic conditions. The location of the DRS 78 increases the pressure differential between the borehole pressure 80 and the pressure of the pressurized oil 82 upwards of 2,000 psi. This is well within the performance envelope of many commercial seal manufacturers. In fact, the existing seals in conventional designs have already been proven to withstand these conditions with only a minor modification aimed at reducing the extrusion gap. FIG. 5 is a schematic diagram depicting example placement of the DRS 78. As illustrated in FIG. 5, in certain embodiments, a rotary connection 84 adjacent the output shaft 56 to facilitate connection with other downhole tool components.

Figure 6:
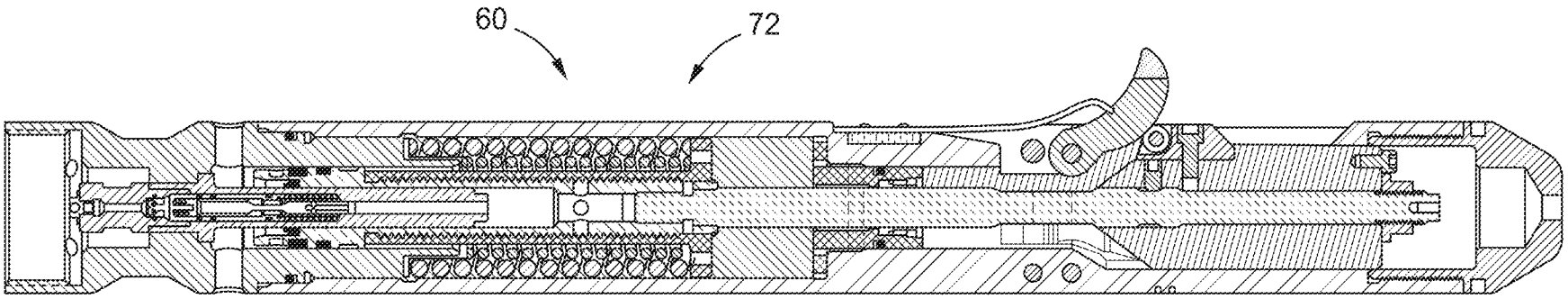
FIG. 6 is a schematic diagram of another embodiment combining a rotary module and hydraulic power delivery, in accordance with embodiments of the present disclosure.

In addition, FIG. 6 is a schematic diagram of another embodiment combining a rotary module and hydraulic power delivery, as described in greater detail herein. In other words, in certain embodiments, the rotary milling module 72 and the components of the hydraulic power system 60 may be directly integrate.

In other embodiments, the hydraulic power system 60 may be used to deliver weight-on-bit for milling applications. For example, a milling bit may be configured to deliver torque while having a translational degree of freedom by means of splines or other keying mechanism. The hydraulic pressure may then be used to push the milling bit into the target with a controlled weight-on-bit directly proportional to the hydraulic pump speed.

In other embodiments, the hydraulic power system 60 may apply axial forces that are converted into radial displacement for tubing cutters. The axial displacement may then be used to push a cam follower onto the cutter curve profile, effectively generating a radial force propelling the cutter into the tube/casing internal diameter.

In other embodiments, the hydraulic power system 60 may deliver pressure to pilot valves for direct radial actuation.

In other embodiments, the hydraulic power system 60 may pressurize packers coated with abrasive materials that can be used to polish casing surfaces. For example, a swelling packer may deliver the contact force between the abrasive material and the casing ID, which may then then be polished by the combination of rotation motion and normal force. Such application may enable a casing intervention service aimed at delivering sealing surfaces for plug/packer placement.

In other embodiments, the hydraulic power system 60 may expand an active centralizer, which may be used to centralize the milling bit. The centralizer may keep the milling bit centered in the hole for milling a ball valve, for example.

In other embodiments, the hydraulic power system 60 may be used to expand a bit that may cut to the outer diameter of the casing for scale removal.

While the present disclosure may be susceptible to various modifications and alternative forms, specific embodiments have been shown by way of example in the drawings and have been described in detail herein. However, it should be understood that the present disclosure is not intended to be limited to the particular forms disclosed. Rather, the present disclosure is intended to cover all modifications, equivalents, and alternatives falling within the spirit and scope of the present disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A downhole well tool hydraulic power system comprising:

a rotary milling module configured to rotate relative to a body of the downhole well tool hydraulic power system;

a hydraulic power system comprising:

an oil compensator configured to deliver a borehole pressure to a compensated hydraulic fluid;

a hydraulic pump module including an inlet fluidly coupled to an outlet of the oil compensator, the hydraulic pump module configured to pressurize the compensated hydraulic fluid for delivery as a pressurized compensated hydraulic fluid at an outlet of the hydraulic pump module; and a hydraulic control module including a first inlet fluidly coupled to the outlet of the oil compensator, a second inlet fluidly coupled to the outlet of the hydraulic pump module, and an outlet fluidly coupled to the rotary milling module, wherein the hydraulic control module is operable between a first state and a second state, the hydraulic control module routing the compensated hydraulic fluid from the outlet of the oil compensator to the rotary milling module in the first state, and the hydraulic control module routing the pressurized compensated hydraulic fluid from the outlet of the hydraulic pump module to the rotary milling module in the second state.

2. The downhole well tool hydraulic power system of claim 1, further comprising a single dynamic rotary seal located on an output shaft of the hydraulic power system.

3. The downhole well tool hydraulic power system of claim 1, wherein the hydraulic power system is configured to control a weight-on-bit of a milling bit using the pressurized compensated hydraulic fluid.

4. The downhole well tool hydraulic power system of claim 1, wherein the hydraulic power system is configured to apply axial forces that are converted to radial displacement for a tubing cutter using the pressurized compensated hydraulic fluid.

5. The downhole well tool hydraulic power system of claim 1, wherein hydraulic power system is configured to deliver the pressurized compensated hydraulic fluid to a pilot valve for direct radial actuation of the pilot valve.

6. The downhole well tool hydraulic power system of claim 1, wherein the hydraulic power system is configured to pressurize a packer using the pressurized compensated hydraulic fluid.

7. The downhole well tool hydraulic power system of claim 1, wherein the hydraulic power system is configured to expand an active centralizer to centralize a milling bit using the pressurized compensated hydraulic fluid.

8. The downhole well tool hydraulic power system of claim 1, wherein the hydraulic power system is configured to expand a bit to cut an outer diameter of a casing for scale removal using the pressurized compensated hydraulic fluid.

9. A downhole well tool, comprising:

a hydraulic power system, comprising:

an oil compensator configured to deliver a borehole pressure to a compensated hydraulic fluid;

a hydraulic pump module including an inlet fluidly coupled to an outlet of the oil compensator, the hydraulic pump module configured to pressurize the compensated hydraulic fluid for delivery as a pressurized compensated hydraulic fluid at an outlet of the hydraulic pump module; and a hydraulic control module including a first inlet fluidly coupled to the outlet of the oil compensator, a second inlet fluidly coupled to the outlet of the hydraulic pump module, and an outlet fluidly coupled to a rotary milling module, wherein the hydraulic control module is operable between a first state and a second state, the hydraulic control module routing the compensated hydraulic fluid from the outlet of the oil compensator to the rotary milling module in the first state, and the hydraulic control module routing the pressurized compensated hydraulic fluid from the outlet of the hydraulic pump module to the rotary milling module in the second state.

10. The downhole well tool of claim 9, further comprising a single dynamic rotary seal located on an output shaft of the hydraulic power system.

11. The downhole well tool of claim 9, wherein the hydraulic power system is configured to control a weight-on-bit of a milling bit using the pressure compensated hydraulic fluid.

12. The downhole well tool of claim 9, wherein the hydraulic power system is configured to apply axial forces that are converted to radial displacement for a tubing cutter using the pressurized compensated hydraulic fluid.

13. The downhole well tool of claim 9, wherein the hydraulic power system is configured to deliver the pressurized compensated hydraulic fluid to a pilot valve for direct radial actuation of the pilot valve.

14. The downhole well tool of claim 9, wherein the hydraulic power system is configured to pressurize a packer using the pressurized compensated hydraulic fluid.

15. The downhole well tool of claim 9, wherein the hydraulic power system is configured to expand an active centralizer to centralize a milling bit using the pressurized compensated hydraulic fluid.

16. The downhole well tool of claim 9, wherein the hydraulic power system is configured to expand a bit to cut an outer diameter of a casing for scale removal using the pressurized compensated hydraulic fluid.

17. A method, comprising:

delivering a borehole pressure to a compensated hydraulic fluid with an oil compensator of a hydraulic power system of a downhole well tool;

delivering the compensated hydraulic fluid from an outlet of the oil compensator to an inlet of a hydraulic pump module of the hydraulic power system the downhole well tool;

delivering the compensated hydraulic fluid from the outlet of the oil compensator to a first inlet of a hydraulic control module;

pressurizing the compensated hydraulic fluid received at the inlet of the hydraulic pump module with the hydraulic pump module for delivery as a pressurized compensated hydraulic fluid;

delivering the pressurized compensated hydraulic fluid from an outlet of the hydraulic pump module to a second inlet of the hydraulic control module; and operating the hydraulic control module between a first state and a second state, the hydraulic control module routing the compensated hydraulic fluid from the outlet of the oil compensator to a rotary milling module in the first state and the hydraulic control module routing the pressurized compensated hydraulic fluid from the outlet of the hydraulic pump module to the rotary milling module in the second state.

* * * * *